US009286906B2

(12) United States Patent
Bonada et al.

(10) Patent No.: US 9,286,906 B2
(45) Date of Patent: Mar. 15, 2016

(54) VOICE PROCESSING APPARATUS

(71) Applicant: Yamaha Corporation, Hamamatsu-shi, Shizuoka-ken (JP)

(72) Inventors: Jordi Bonada, Barcelona (ES); Merlijn Blaauw, Barcelona (ES); Yuji Hisaminato, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 134 days.

(21) Appl. No.: 13/923,203

(22) Filed: Jun. 20, 2013

(65) Prior Publication Data

US 2014/0006018 A1 Jan. 2, 2014

(30) Foreign Application Priority Data

Jun. 21, 2012 (JP) ..... 2012-139455

(51) Int. Cl.
*G10L 21/013* (2013.01)
*G10L 19/26* (2013.01)

(52) U.S. Cl.
CPC ..... *G10L 19/265* (2013.01); *G10L 21/013* (2013.01)

(58) Field of Classification Search
USPC ..... 704/200–230
See application file for complete search history.

(56) References Cited

U.S. PATENT DOCUMENTS 5,327,521 A * 7/1994 Savic et al. ..... 704/272
5,567,901 A * 10/1996 Gibson et al. ..... 84/603
6,336,092 B1 * 1/2002 Gibson et al. ..... 704/268

FOREIGN PATENT DOCUMENTS

JP 2008-058986 A 3/2008

OTHER PUBLICATIONS

Laroche, J. (Sep. 8-11, 2003). "Frequency-Domain Techniques for High-Quality Voice Modification," Proc. of the 6th Int. Conference on Digital Audio Effects, London, UK, five pages.
Notice of Reason for Rejection dated Oct. 28, 2014, for Japanese Patent Application No. 2012-139455, with English translation, six pages.

* cited by examiner

*Primary Examiner* — Abul Azad
(74) *Attorney, Agent, or Firm* — Morrison & Foerster LLP

(57) ABSTRACT

In a voice processing apparatus, a processor is configured to adjust, a fundamental frequency of a first voice signal corresponding to a voice having target voice characteristics to a fundamental frequency of a second voice signal corresponding to a voice having initial voice characteristics different from the target voice characteristics. The processor is further configured to sequentially generate a processed spectrum based on a spectrum of the first voice signal and a spectrum of the second voice signal by: dividing the spectrum of the first voice signal into a plurality of harmonic band components after the fundamental frequency of the first voice signal has been adjusted; allocating each harmonic band component of the first voice signal to each harmonic frequency associated with the fundamental frequency of the second voice signal; and adjusting an envelope and phase of each harmonic band component according to the spectrum of the second voice signal.

17 Claims, 2 Drawing Sheets

VOICE PROCESSING APPARATUS

BACKGROUND OF THE INVENTION

1. Technical Field of the Invention

The present invention relates to technology for processing a voice signal.

2. Description of the Related Art

Technology for converting characteristics of voice has been proposed, for example, by Jean Laroche, "Frequency-Domain Techniques for High-Quality Voice Modification", Proc. of the $6^{th}$ Int. Conference on Digital Audio Effects. 2003. This reference discloses technology for converting a fundamental frequency (pitch) and characteristics of voice by appropriately shifting each band component obtained by dividing a spectrum of a voice signal into harmonic components (fundamental harmonic component and higher order harmonic components) in the frequency domain.

However, since the technology of the above noted reference converts a fundamental frequency by shifting band components of the spectrum of a voice signal in the frequency domain, when a harmonic component and another sound component (referred to as "ambient component" hereinafter) are present in each band component, it is difficult to generate a natural voice having a frequency-phase relationship appropriately maintained for both the harmonic component and the ambient component. It is possible to generate a natural voice by respectively adjusting phases of the harmonic component and the ambient component through different methods. However, in case of peculiar voice, for example, a thick voice (thick gravelly voice) or hoarseness (husky voice), an ambient component tends to vary greatly with time, and thus it is difficult to adjust the phase of the ambient component to an appropriate value separately from a harmonic component.

SUMMARY OF THE INVENTION

In view of this problem, an object of the present invention is to generate a natural voice through conversion of voice characteristics.

Means employed by the present invention to solve the above-noted problem will be described. To facilitate understanding of the present invention, correspondence between components of the present invention and components of embodiments which will be described later is indicated by parentheses in the following description. However, the present invention is not limited to the embodiments.

A voice processing apparatus of the present invention comprises one or more of processors configured to: adjust, in the time domain, a fundamental frequency (e.g. fundamental frequency PS) of a first voice signal (e.g. target voice signal QB) corresponding to a voice having target voice characteristics to a fundamental frequency (e.g. fundamental frequency PV) of a second voice signal (e.g. voice signal VX) corresponding to a voice having initial voice characteristics different from the target voice characteristics; and sequentially generate a processed spectrum (e.g. spectrum Y[k]) based on a spectrum of the first voice signal and a spectrum of the second voice signal by: dividing the spectrum (e.g. spectrum S[k]) of the first voice signal into a plurality of harmonic band components after the fundamental frequency of the first voice signal has been adjusted to the fundamental frequency of the second voice signal; allocating each harmonic band component (e.g. harmonic band component H[i]) obtained by dividing the spectrum of the first voice signal to each harmonic frequency (e.g. harmonic frequency fi) associated with the fundamental frequency of the second voice signal; and adjusting an envelope and phase of each harmonic band component according to an envelope and phase of the spectrum of the second voice signal.

In this configuration, since the fundamental frequency of the first voice signal is adjusted to the fundamental frequency of the second voice signal in the time domain before voice characteristic conversion, even when a harmonic component and an ambient component are present in each harmonic band component, a frequency-phase relationship is appropriately maintained for both the harmonic component and ambient component. Accordingly, it is possible to generate an acoustically natural voice.

In a preferred embodiment of the present invention, the processor is configured to allocate an i-th harmonic band component (i is a positive integer) of the spectrum of the first voice signal after adjustment of the fundamental frequency thereof to each harmonic frequency near an i-th harmonic component of the spectrum of the first voice signal before adjustment of the fundamental frequency thereof. According to this configuration, it is possible to generate a voice in which the voice characteristics of the first voice signal are sufficiently reflected.

Furthermore, the processor is configured to adjust the fundamental frequency of the first voice signal by sampling the first voice signal according to the ratio of the fundamental frequency of the first voice signal to the fundamental frequency of the second voice signal.

In a voice processing apparatus according to a preferred embodiment of the present invention, the processor is further configured to generate the first voice signal by successively extracting periods from a target voice signal (e.g. target voice signal QA) which is obtained by steadily voicing a specific phoneme with the target voice characteristics, and by connecting the periods in the time domain.

According to this configuration, since the first voice signal is generated by repeating the periods of the target voice signal, storage capacity necessary to store a voice signal corresponding to the target voice characteristics can be reduced as compared to a configuration in which the first voice signal having a long duration is previously stored.

In a voice processing apparatus according to a preferred embodiment of the present invention, the processor is further configured to weight the processed spectrum relative to the spectrum of the second voice signal, and to mix the spectrum of the second voice signal and the weighted spectrum. According to this configuration, it is possible to variably control a degree to which voice characteristics are approximated to the target voice characteristics by appropriately selecting a weight value.

A voice processing apparatus according to a preferred embodiment of the present invention includes a voice synthesizer for generating a second voice signal corresponding to a voice having a pitch and a phoneme designated by a user by connecting phonemes of target voice characteristics. In this configuration, since voice characteristics of the second voice signal generated by the voice synthesizer are changed, it is possible to generate voice signals having various voice characteristics even in an environment in which only specific initial voice characteristics are available.

The voice processing apparatus according to each embodiment of the present invention may not only be implemented by hardware (electronic circuitry) dedicated for music analysis, such as a digital signal processor (DSP), but may also be implemented through cooperation between a general operation processing device such as a central processing unit (CPU) and a program. A program according to the invention is executed, on a computer, to: adjust, in the time domain, a fundamental frequency of a first voice signal corresponding to a voice having target voice characteristics to a fundamental frequency of a second voice signal corresponding to a voice having initial voice characteristics different from the target voice characteristics; and sequentially generate a processed spectrum based on a spectrum of the first voice signal and a spectrum of the second voice signal by: dividing the spectrum of the first voice signal into a plurality of harmonic band components after the fundamental frequency of the first voice signal has been adjusted to the fundamental frequency of the second voice signal; allocating each harmonic band component obtained by dividing the spectrum of the first voice signal to each harmonic frequency associated with the fundamental frequency of the second voice signal; and adjusting an envelope and phase of each harmonic band component according to an envelope and phase of the spectrum of the second voice signal.

According to this program, the same operation and effect as those of the voice processing apparatus according to the present invention can be achieved. The program according to each embodiment of the present invention can be stored in a computer readable recording medium and installed on a computer, or distributed through a communication network and installed in a computer.

DETAILED DESCRIPTION OF THE INVENTION

Figure 1:
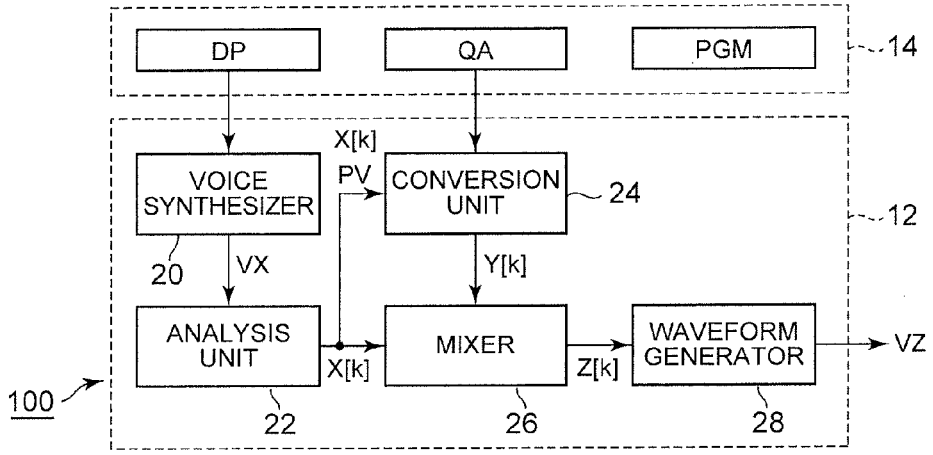
FIG. 1 is a block diagram of a voice processing apparatus according to a first embodiment of the present invention.

FIG. 1 is a block diagram of a voice processing apparatus 100 according to a preferred embodiment of the present invention. The voice processing apparatus 100 of an embodiment described below is a signal processing apparatus (voice synthesis apparatus) generating a voice signal VZ of the time domain, which represents the waveform of a voice having an arbitrary pitch and phoneme, and is implemented as a computer system including a processing unit 12 and a storage unit 14.

The processing unit 12 implements a plurality of functions (functions of a voice synthesizer 20, an analysis unit 22, a conversion unit 24, a mixer 26, and a waveform generator 28) for generating the voice signal VZ by executing a program PGM stored in the storage unit 14. The storage unit 14 stores the program PGM executed by the processing unit 12 and data used by the processing unit 12. A known recording medium such as a semiconductor recording medium and a magnetic recording medium or a combination of various types of recording media may be employed as the storage unit 14.

The storage unit 14 stores a plurality of phonemes DP previously acquired from a voice having specific characteristics (referred to as "initial voice characteristics" hereinafter). Each phoneme DP is a single phoneme corresponding to a linguistic minimum unit of a voice or a phoneme chain (diphone or triphone) obtained by connecting a plurality of phonemes and is represented as a spectrum of the frequency domain or a voice waveform of the time domain.

The storage unit 14 stores a target voice signal QA of the time domain, which corresponds to a voice having specific characteristics (referred to as "target voice characteristics" hereinafter) different from the initial voice characteristics. The target voice signal QA is a sample series of a voice in a predetermined duration, which is obtained by steadily voicing a specific phoneme (typically a vowel) at a constant pitch. While the target voice characteristics and the initial voice characteristics are voice characteristics of different speakers, different voice characteristics of a single speaker may be used as the target voice characteristics and the initial voice characteristics. The target voice characteristics according to the present embodiment are non-modal characteristics, compared to the initial voice characteristics. Specifically, characteristics of a voice spoken by a behavior different from a normal speaking behavior, are suitable as the target voice characteristics. For example, a thick voice (thick gravelly voice), hoarseness (husky voice) or growl can be exemplified as the target voice characteristics.

The voice synthesizer 20 generates a voice signal VX of the time domain, which represents the waveform of a voice having a pitch and phonemes arbitrarily designated by a user as the initial voice characteristics. The voice synthesizer 20 according to the present embodiment generates the voice signal VX through a phoneme connection type voice synthesis process using the phonemes DP stored in the storage unit 14. That is, the voice synthesizer 20 generates the voice signal VX by sequentially selecting phonemes corresponding to the phonemes (spoken letters) designated by the user from the storage unit 14, connecting the selected phonemes in the time domain and adjusting the connected phonemes to the pitch designated by the user. A known technique may be employed to generate the voice signal VX.

The analysis unit 22 sequentially generates a spectrum (complex spectrum) X[k] of the voice signal VX generated by the voice synthesizer 20 in unit periods (frames) in the time domain, and sequentially designates a fundamental frequency (pitch) PV of the voice signal VX in the unit periods. Here, the symbol k denotes a frequency (frequency bin) from among a plurality of frequencies discretely set in the frequency domain. A known frequency analysis method such as short-time Fourier transform may be employed to calculate the spectrum X[k] and a known pitch detection method may be employed to designate the fundamental frequency PV. The fundamental frequency PV of each unit period may be designated from the pitch (pitch designated to a time series by the user) applied to voice synthesis according to the voice synthesizer 20.

The conversion unit 24 converts the initial voice characteristics to the target voice characteristics while maintaining the pitch and phonemes of the voice signal VX generated by the voice synthesizer 20. That is, the conversion unit 24 sequentially generates a spectrum (complex spectrum) of a voice signal VY representing a processed voice having the pitch and phonemes (tone) of the voice signal VX as the target voice characteristics in the respective unit periods. The process performed by the conversion unit 24 will be described in detail below.

The mixer 26 sequentially generates a spectrum Z[k] of the voice signal VZ in the respective unit periods by mixing the voice signal VX (spectrum X[k]) generated by the voice synthesizer 20 and the voice signal VY (spectrum Y[k]) generated by the conversion unit 24. Specifically, the mixer 26 calculates the spectrum Z[k] by performing weighted summation on the spectrum X[k] of the initial voice characteristics and the spectrum Y[k] of the target voice characteristics, as represented by Equation (1).

$$Z[k]=wY[k]+(1-w)X[k] \quad (1)$$

In Equation (1), weight w is set within the range of 0 to 1. As can be seen from Equation (1), a degree to which characteristics of the voice signal VZ approximate to the target voice characteristics is adjusted based on the weight w. Specifically, the characteristics of the voice signal VZ become closer to the target voice characteristics as the weight w increases. For example, the weight w varies with time according to user instruction. Accordingly, a degree to which the target voice characteristics are reflected in the characteristics of the voice signal VZ varies time to time.

The waveform generator 28 generates the voice signal VZ of the time domain from the spectrum Z[k] generated by the mixer 26 for each unit period. Specifically, the waveform generator 28 generates the voice signal VZ by transforming the spectrum Z[k] of each unit period into a waveform of time domain through short-time Fourier transform and summing consecutive waveforms while overlapping the consecutive waveforms in the time domain. The voice signal VZ generated by the waveform generator 28 is supplied to a sound output device (not shown) and output as sound waves.

Figure 2:
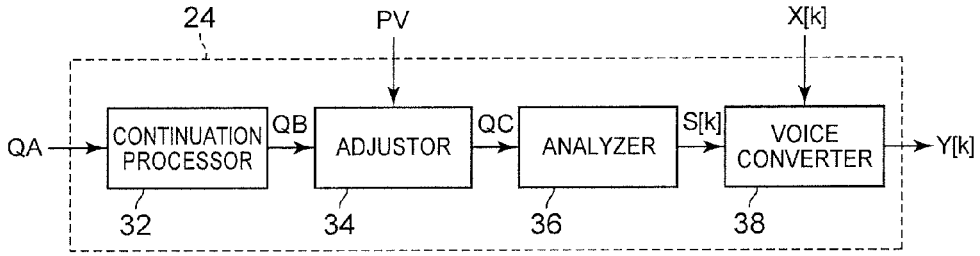
FIG. 2 is a block diagram of a conversion unit.

A detailed configuration and operation of the conversion unit 24 will now be described. FIG. 2 is a block diagram of the conversion unit 24. As shown in FIG. 2, the conversion unit 24 includes a continuation processor 32, an adjustor 34, an analyzer 36 and a voice characteristic converter 38.

The continuation processor 32 connects periods (intervals) appropriately extracted from the target voice signal QA having the target voice characteristics, stored in the storage unit 14, in the time domain to generate a target voice signal QB having the target voice characteristics and a duration longer than that of the target voice signal QA.

Figure 3:
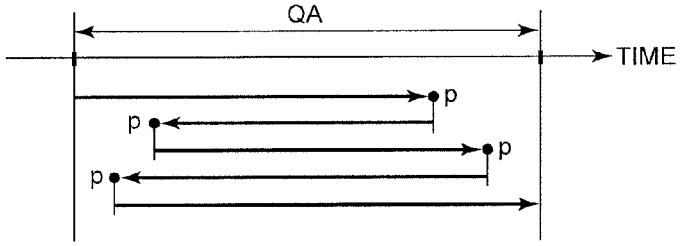
FIG. 3 illustrates an operation of a continuation processor.

Specifically, as shown in FIG. 3, the continuation processor 32 generates the target voice signal QB by sequentially setting random points p between the start point and the end point of the target voice signal QA and sequentially extracting each sample between consecutive points p in a forward direction (forward in time) or backward direction (backward in time) (random loop). Since the target voice signal QB is generated through temporal repetition (looping) of the target voice signal QA having a predetermined duration, as described above, storage capacity of the storage unit 14 can be reduced compared to a configuration in which the target voice signal QB in a long duration is stored in the storage unit 14.

The adjustor 34 shown in FIG. 2 generates a target voice signal QC in the time domain by adjusting the fundamental frequency (pitch-shifting) of the target voice signal QB generated by the continuation processor 32 to the fundamental frequency PV of the voice signal VX. Specifically, the adjuster 34 generates the target voice signal QC corresponding to a voice produced with the fundamental frequency PV as the target voice characteristics by sampling (resampling) the target voice signal QB in the time domain. The target voice signal QC has the same phonemes as those of the target voice signal QB. The rate R of sampling according to the adjustor 34 is set to the ratio of the fundamental frequency PV of the voice signal VX designated by the analyzer 22 to a fundamental frequency PS designated from the target voice signal QB (R=PV/PS). That is, when the fundamental frequency PV exceeds the fundamental frequency PS (R>1), the target voice signal QB is sampled on a short cycle compared to when the target voice signal QB is stored, and thus the fundamental frequency increases. On the contrary, when the fundamental frequency PV is less than the fundamental frequency PS (R<1), the target voice signal QB is sampled on a long cycle compared to when the target voice signal QB is stored, and thus the fundamental frequency decreases. A known pitch detection method is employed to designate the fundamental frequency PS. Furthermore, the fundamental frequency PS may be previously stored along with the target voice signal QA in the storage unit 14 and used to calculate the rate R.

The analysis unit 36 shown in FIG. 2 sequentially generates a spectrum (complex spectrum) S[k] of the target voice signal QC generated through adjustment according to the adjustor 34 in the time domain for the respective unit periods. A known frequency analysis method such as short-time Fourier transform may be employed to calculate the spectrum S[k].

The voice characteristic converter 38 sequentially generates a spectrum Y[k] of the voice signal VY generated with the pitch and phonemes of the voice signal VX as the target voice characteristics in the respective unit periods using the spectrum X[k] calculated for each unit period by the analyzer 22 from the voice signal VX and the spectrum S[k] of the target voice characteristics generated for each unit period by the analysis unit 36. Specifically, the voice characteristic converter 38 generates the spectrum Y[k] of each unit period by: segmenting the spectrum S[k] of the target voice characteristics into a plurality of bands corresponding to different harmonic components (first harmonic and second or higher harmonic components) in the frequency domain, as shown in FIG. 4; then rearranging a sound component (referred to as "harmonic band component" hereinafter) of each band H[i] in the frequency domain in response to the above-described rate R; and adjusting the intensity (amplitude) and phase of each harmonic band component H[i] based on the spectrum X[k] of the initial voice characteristics.

Figure 4:
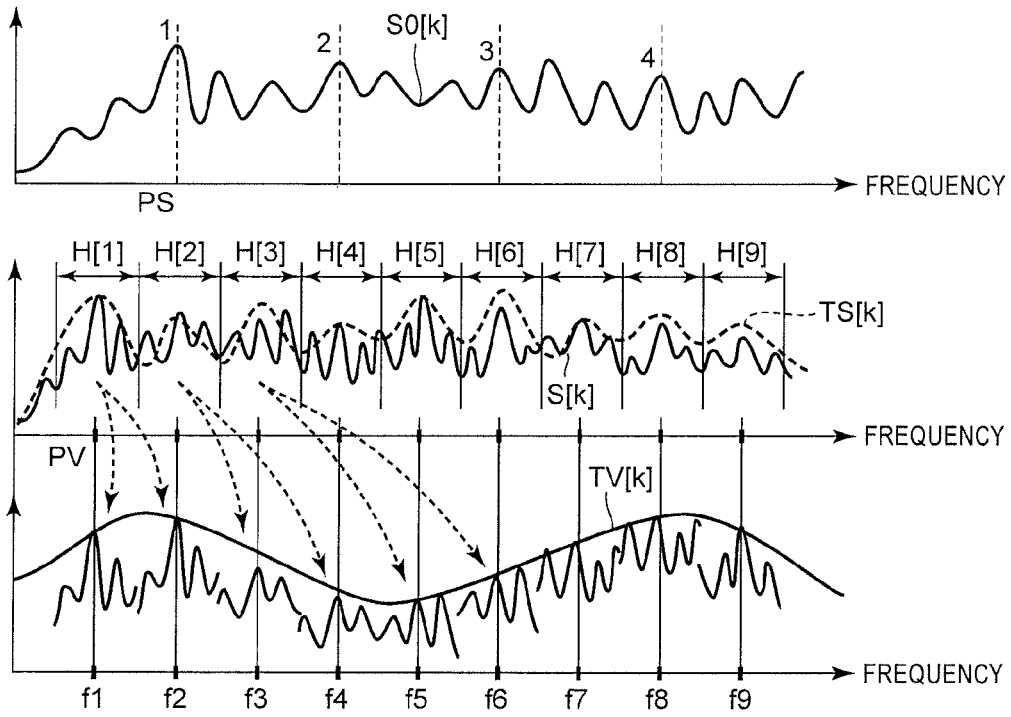
FIG. 4 illustrates an operation of a voice characteristic converter.

FIG. 4 shows a spectrum S0[k] of the target voice signal QB before adjustment according to the adjustor 34. In FIG. 4, the frequency fi (i=1, 2, 3, . . . ) is a frequency (referred to as "harmonic frequency" hereinafter) corresponding to an i-th harmonic component (i is a positive integer) of the spectrum S[k] after adjustment according to the adjustor 34. As can be seen from FIG. 4, the i-th harmonic component H[i] of the spectrum S[k] of the target voice characteristics is allocated (mapped) to each harmonic frequency fi near the i-th harmonic component (first harmonic component or a second or higher harmonic component) in the spectrum S0[k] before adjustment (pitch change) according to the adjustor 34.

For example, when the fundamental frequency PV of the voice signal VX corresponds to half the fundamental frequency PS of the target voice signal QA (QB) (R=PV/PS=0.5), the first harmonic band component H[1] of the spectrum S[k] is repetitively mapped to the harmonic frequency f1 and harmonic frequency f2 disposed near the fundamental frequency PS before being adjusted, and the second harmonic band component H[2] is repetitively mapped to the harmonic frequency f3 and harmonic frequency f4 disposed near a frequency (harmonic frequency) twice the fundamental frequency PS before being adjusted. That is, each harmonic band component H[i] of the spectrum S[k] is repetitively arranged in the frequency domain when the fundamental frequency PV of the voice signal VX is less than the fundamental frequency PS of the target voice signal QB (R<1), and a plurality of harmonic band components H[i] of the spectrum S[k] is appropriately selected and arranged in the frequency domain when the fundamental frequency PV exceeds the fundamental frequency PS (R>1), as shown in FIG. 4.

Specifically, the voice characteristic converter 38 according to the present embodiment calculates a band component Yi[k] with respect to each harmonic frequency fi according to Equation (2).

$$Y_i[k]=S[k+d_i]\cdot a_i\exp(j\phi_i) \tag{2}$$

In Equation (2), $d_i$ denotes a shift in the frequency domain when the harmonic band component H[i] in the spectrum S[k]

of the target voice characteristics is mapped to each harmonic frequency fi, and is defined by Equation (3).

$$d_i = \left\langle (P_V \cdot i - P_S \cdot m_i)\frac{L}{FS} + 0.5 \right\rangle \tag{3}$$

In Equation (3), ⟨ ⟩ denotes a floor function. That is, a function ⟨x+0.5⟩ is an arithmetic operation for rounding off a numerical value x to the nearest integer. In addition, L represents the duration (window length) of a unit period in short-time Fourier transform performed by the analysis unit 36 and FS represents a sampling frequency of the target voice signal QB.

In Equation (3), $m_i$ is a variable determining the correspondence relation between each harmonic band component H[i] and each harmonic frequency fi after being mapped with respect to the spectrum S[k] of the target voice characteristics, and is defined by Equation (4).

$$m_i = \left\langle \frac{i}{R} + 0.5 \right\rangle \tag{4}$$

In Equation (2), $a_i$ is an adjustment value (gain) for adjusting the intensity of the harmonic band component H[i] in response to the spectrum X[k] of the initial voice characteristics and is calculated for each harmonic frequency fi according to Equation (5), for example.

$$a_i = \frac{T_V[f_i]}{T_S[f_i/R]} \tag{5}$$

In Equation (5), $T_V$ denotes the envelope of the intensity (amplitude or power) of the spectrum X[k] of the voice signal VX and $T_S$ denotes the envelope of the intensity of the spectrum S[k] of the target voice characteristics. As can be seen from Equations (2) and (5), the intensity (intensity of peak corresponding to the harmonic component) of the harmonic band component H[i] is adjusted to a value based on the envelope $T_V$, of the spectrum X[k] of the voice signal VX.

In Equation (3), $\phi_i$ is an adjustment value (rotation angle of the phase of the harmonic band component H[i]) by which the phase of the harmonic band component H[i] corresponds to the spectrum X[k] of the initial voice characteristics, and is calculated for each harmonic frequency fi according to Equation (6), for example.

$$\phi_i = \angle \frac{X\left(\left\langle \frac{P_V \cdot i \cdot L}{FS} + 0.5 \right\rangle\right)}{S\left(\left\langle \frac{P_S \cdot m_i \cdot L}{FS} + 0.5 \right\rangle\right)} \tag{6}$$

In Equation (6), ∠ represents a deflection angle. As is seen from Equations (2) and (6), the phase of the harmonic band component H[i] is adjusted to the phase of the spectrum X[k] of the voice signal VX.

The voice characteristic converter 38 generates the spectrum Y[k] of the voice signal VY for each unit period by arranging a plurality of band components Yi[k] (Y1[k], Y2[k], . . . ) calculated according to the above operations in the frequency domain. As is understood from the above description, the spectrum Y[k] generated by the voice characteristic converter 38 envelopes a fine structure (that is, a structure reflecting a behavior of vocal cords when the target voice characteristics are voiced) close to the spectrum S[k] of the target voice characteristics, and approximates the envelope and phase to the voice signal VX. That is, the spectrum Y[k] of voice having the same pitch and phoneme (tone) as the voice signal VX as the target voice characteristics is generated.

In the above-described embodiment, since the fundamental frequency PS of the target voice signal QB is adjusted to the fundamental frequency PV of the voice signal VX before voice characteristic conversion according to the voice characteristic converter 38, when a harmonic component and an ambient component (sub-harmonic) are present in each harmonic band component H[i], the frequency-phase relationship is appropriately maintained for both the harmonic component and ambient component. Accordingly, even when a thick voice or a hoarseness in which ambient components are frequently generated in each harmonic band component H[i] and each ambient component tends to vary time to time is used as the target voice characteristics, a complicated process for respectively adjusting phases of a harmonic component and an ambient component through different methods is not needed and an acoustically natural voice can be generated. In the first embodiment, since each harmonic band component H[i] of the target voice signal QB is mapped to each harmonic frequency fi near the i-th harmonic component in the spectrum S0[k] before adjustment according to the adjuster 34, it is possible to generate a voice in which the voice characteristics of the target voice signal QB are sufficiently reflected.

MODIFICATIONS

The above-described embodiment can be modified in various manners. Detailed modifications will be described below. Two or more embodiments arbitrarily selected from the following embodiments can be appropriately combined.

(1) While the target voice signal QB is generated by connecting intervals having turning points p randomly set in the target voice signal QA as end points in the above embodiment, a method of expanding the original target voice signal QA is not limited to the above-described example. For example, the target voice signal QB may be generated by repeating the entire period (duration) of the target voice signal QA. Specifically, it is possible to follow the target voice signal QA from the start point to the end point in the forward direction and return to the start point upon arriving at the end point. In addition, it is possible to follow the target voice signal QA in the forward direction or backward direction and, upon arriving at an end point (start point or end point), follow the target voice signal QA in the opposite direction. In a configuration in which the target voice signal QB having a sufficient duration is stored in the storage unit 14, the continuation processor 32 can be omitted.

(2) While the voice signal VZ corresponding to a mixture of the spectrum X[k] of the initial voice characteristics and the spectrum Y[k] of the target voice characteristics is output in the above embodiment, the voice signal VY generated from the spectrum Y[k] of the target voice characteristics alone may be output (e.g. reproduced). That is, the mixer 26 may be omitted.

(3) While the voice characteristics of the voice signal VX generated by the voice synthesizer 20 are converted in the above embodiment, the processing target of the convertor 24 is not limited to the voice signal VX. For example, a voice signal VX supplied from a signal supply apparatus can be converted by the converter 24. For example, a sound acquisition device that generates the voice signal VX by collecting live voice, a reproduction device that acquires the voice signal VX from a portable or built-in recording medium, or a communication device that receives the voice signal VX from a communication network can be used as the signal supply apparatus. As is understood from the above description, the voice synthesizer 20 may be omitted.

(4) The sequence of processing by the converter 24 may be appropriately modified. For example, considering a case in which the adjustor 34 decreases the fundamental frequency PS of the target voice signal QB (case in which distribution of harmonic components in the frequency domain is changed to a dense distribution), the fine structure of the target voice signal QB may not be sufficiently reflected in the spectrum S[k] (that is, fine structure in the frequency domain of the target voice signal QB may be damaged) in the above-described configuration in which the analyzer 36 calculates the spectrum S[k] based on a predetermined frequency resolution after processing by the adjustor 34. Accordingly, it is desirable that the analyzer 36 calculates the spectrum S[k] after processing by the adjustor 34 in the same manner as the above-described embodiment when the fundamental frequency PV exceeds the fundamental frequency PS (R>1) and processing (decreasing the fundamental frequency PS) by the adjustor 34 be performed after calculation of the spectrum S[k] by the analyzer 36 when the fundamental frequency PV is less than the fundamental frequency PS (R<1).

(5) A plurality of target voice signals QA corresponding to different fundamental frequencies PS may be selectively used. In this case, the converter 24 calculates the average Pave of fundamental frequencies PV corresponding to a plurality of unit periods of the voice signal VX and selects a target voice signal QA having a fundamental frequency PS close to the average Pave from a plurality of target voice signals QA. In this configuration, a target voice signal QA having a fundamental frequency PS similar to the fundamental frequency PV of the voice signal VX is selected, and thus, an acoustically natural voice can be generated compared to a case in which a single target voice signal QA is processed.

(6) While the phonemes DP and the target voice signal QA are stored in the storage unit 14 in the above-described embodiment, it is possible to employ a configuration in which the phonemes DP and the target voice signal QA are stored in an external device (e.g. server device) provided separately from the voice processing apparatus 100, and the voice processing apparatus 100 acquires the phonemes DP and the target voice signal QA from the external device through a communication network (e.g. Internet). That is, a component storing the phonemes DP and the target voice signal QA is not an essential component of the voice processing apparatus 100. Furthermore, the voice processing apparatus 100 may generate the voice signal VZ from the voice signal VX received from a terminal device through a communication network and return the voice signal VZ to the terminal device.

What is claimed is:

1. A voice processing apparatus comprising one or more of processors configured to:

adjust, in the time domain, a fundamental frequency of a first voice signal corresponding to a voice having target voice characteristics to a fundamental frequency of a second voice signal corresponding to a voice having initial voice characteristics different from the target voice characteristics; and sequentially generate a processed spectrum based on a spectrum of the first voice signal and a spectrum of the second voice signal by:

dividing the spectrum of the first voice signal into a plurality of harmonic band components after the fundamental frequency of the first voice signal has been adjusted to the fundamental frequency of the second voice signal;

allocating each harmonic band component obtained by dividing the spectrum of the first voice signal to each harmonic frequency associated with the fundamental frequency of the second voice signal; and adjusting an envelope and phase of each harmonic band component according to an envelope and phase of the spectrum of the second voice signal.

2. The voice processing apparatus of claim 1, wherein the processor is configured to allocate an i-th harmonic band component of the spectrum of the first voice signal after adjustment of the fundamental frequency thereof to each harmonic frequency near an i-th harmonic component of the spectrum of the first voice signal before adjustment of the fundamental frequency thereof, wherein i is a positive integer.

3. The sound processing apparatus of claim 1, wherein the processor is configured to adjust the fundamental frequency of the first voice signal by sampling the first voice signal according to the ratio of the fundamental frequency of the first voice signal to the fundamental frequency of the second voice signal.

4. The sound processing apparatus of claim 1, wherein the processor is further configured to generate the first voice signal by successively extracting periods from a target voice signal which is obtained by steadily voicing a specific phoneme with the target voice characteristics, and by connecting the periods in the time domain.

5. The sound processing apparatus of claim 1, wherein the processor is further configured to weight the processed spectrum relative to the spectrum of the second voice signal, and to mix the spectrum of the second voice signal and the weighted spectrum.

6. The sound processing apparatus of claim 1, wherein the processor is configured to generate the first voice signal representing a sample voice of a predetermined duration obtained by voicing a specific phoneme.

7. The sound processing apparatus of claim 1, wherein the processor is configured to generate the first voice signal by repeatedly reading, in a forward direction or backward direction, an entire period of a target voice signal which is obtained by steadily voicing a specific phoneme with the target voice characteristics.

8. The sound processing apparatus of claim 1, wherein the processor is configured to generate the first voice signal which is selected from a plurality of target voice signals having different target voice characteristics.

9. A voice processing method comprising the steps of:

adjusting, in the time domain, a fundamental frequency of a first voice signal corresponding to a voice having target voice characteristics to a fundamental frequency of a second voice signal corresponding to a voice having initial voice characteristics different from the target voice characteristics; and sequentially generating a processed spectrum based on a spectrum of the first voice signal and a spectrum of the second voice signal by the steps of:

dividing the spectrum of the first voice signal into a plurality of harmonic band components after the fundamental frequency of the first voice signal has been adjusted to the fundamental frequency of the second voice signal;

allocating each harmonic band component obtained by dividing the spectrum of the first voice signal to each harmonic frequency associated with the fundamental frequency of the second voice signal; and adjusting an envelope and phase of each harmonic band component according to an envelope and phase of the spectrum of the second voice signal.

10. The voice processing method of claim 9, wherein the allocating step allocates an i-th harmonic band component of the spectrum of the first voice signal after adjustment of the fundamental frequency thereof to each harmonic frequency near an i-th harmonic component of the spectrum of the first voice signal before adjustment of the fundamental frequency thereof, wherein is a positive integer.

11. The sound processing method of claim 9, wherein the adjusting step adjusts the fundamental frequency of the first voice signal by sampling the first voice signal according to the ratio of the fundamental frequency of the first voice signal to the fundamental frequency of the second voice signal.

12. The sound processing method of claim 9, further comprising the step of generating the first voice signal by successively extracting periods from a target voice signal which is obtained by steadily voicing a specific phoneme with the target voice characteristics, and by connecting the periods in the time domain.

13. The sound processing method of claim 9, further comprising the steps of weighting the processed spectrum relative to the spectrum of the second voice signal, and mixing the spectrum of the second voice signal and the weighted spectrum.

14. The sound processing method of claim 9, further comprising the step of generating the first voice signal representing a sample voice of a predetermined duration obtained by voicing a specific phoneme.

15. The sound processing method of claim 9, further comprising the step of generating the first voice signal by repeatedly reading, in a forward direction or backward direction, an entire period of a target voice signal which is obtained by steadily voicing a specific phoneme with the target voice characteristics.

16. The sound processing method of claim 9, further comprising the step of generating the first voice signal which is selected from a plurality of target voice signals having different target voice characteristics.

17. A machine readable non-transitory storage medium for use in a computer, the medium containing program instructions executable by the computer to:

adjust, in the time domain, a fundamental frequency of a first voice signal corresponding to a voice having target voice characteristics to a fundamental frequency of a second voice signal corresponding to a voice having initial voice characteristics different from the target voice characteristics; and sequentially generate a processed spectrum based on a spectrum of the first voice signal and a spectrum of the second voice signal by:

dividing the spectrum of the first voice signal into a plurality of harmonic band components after the fundamental frequency of the first voice signal has been adjusted to the fundamental frequency of the second voice signal;

allocating each harmonic band component obtained by dividing the spectrum of the first voice signal to each harmonic frequency associated with the fundamental frequency of the second voice signal; and adjusting an envelope and phase of each harmonic band component according to an envelope and phase of the spectrum of the second voice signal.

* * * * *